US006053823A

United States Patent [19]

Mathews

[11] Patent Number: 6,053,823

[45] Date of Patent: Apr. 25, 2000

[54] METHOD FOR CONDUCTING CHAMPIONSHIP PLAYOFF

[76] Inventor: Marc Mathews, 4263 W. Jasper Dr., Chandler, Ariz. 85226

[21] Appl. No.: 09/118,302

[22] Filed: Jul. 17, 1998

Related U.S. Application Data

[60] Provisional application No. 60/053,046, Jul. 21, 1997.

[51] Int. Cl.[7] ..... A63B 71/02

[52] U.S. Cl. ..... 473/415; 473/470; 700/91; 700/92; 700/93

[58] Field of Search ..... 473/465, 470, 473/415; 273/459; 700/91–93

[56] References Cited

PUBLICATIONS

CNNSI.COM, "Numbers Crunch Time", Jun. 9, 1998.
CNNSI.COM, "Family Feud", Jun. 12, 1998.
CNNSI.COM, "Picking the Title Teams", Jun. 9, 1998.

*Primary Examiner*—Mark S. Graham
*Attorney, Agent, or Firm*—Koley, Jessen, Daubman & Rupiper, P.C.; Mark D. Frederiksen

[57] ABSTRACT

A method for conducting a championship playoff includes the steps of ranking participating teams after a regular season by adding the ranks of each team based upon at least two different polls, and assigning a final rank for each team based upon the summation of these polls. A championship tournament is then conducted with a plurality of rounds of events to reduce the initial number of teams to a single champion. In the preferred embodiment of the invention, one poll is a poll of sports writers, a second poll is a poll of coaches, and a third poll is an objective poll, with the first and second polls being weighted more heavily than the objective poll. Each round of events in the championship playoff would be played at different site locations. A secondary tournament would be conducted utilizing the highest ranked teams below those which are utilized in the championship tournament. The secondary tournament would include a plurality of rounds of events to narrow the teams to a single champion of the secondary tournament. The secondary tournament rounds are played at different locations than the championship tournament rounds, and are played on different days than the championship rounds.

19 Claims, No Drawings

METHOD FOR CONDUCTING CHAMPIONSHIP PLAYOFF

CROSS-REFERENCES TO RELATED APPLICATION

This application claims the benefit of U.S. Provisional Application Ser. No. 60/053,046 filed Jul. 21, 1997.

TECHNICAL FIELD

The present invention relates generally to methods for conducting a series of sporting events, and more particularly to an improved method for conducting a championship football tournament.

BACKGROUND OF THE INVENTION

The current system for determining a national champion in NCAA Division I college football is based solely on two polls, a coaches' poll and a writers' poll. These polls, while useful for general rankings of teams, have proven to be inconsistent and controversial in attempting to select a national champion. In fact, Division 1A football is the only sport in any of the 80 divisions of the NCAA which does not have a championship tournament.

While critics of the current bowl system for post-season play have provided numerous reasons for change to a playoff system, some of the major factors include the following. First, because the top two ranked teams do not necessarily compete with one another in a bowl game, there are frequent disputes as to the true national champion for two teams with identical wins/loss records. The importance of a particular bowl game can vary greatly depending upon the two teams which are chosen to play in the game, as well as the particular day on which the game is played. For the same reason, attendance at many bowl games has decreased. Finally, smaller schools and conferences may not be fairly represented in the current post-season and structure.

SUMMARY OF THE INVENTION

It is therefore a general object of the present invention to provide an improved method for conducting a national championship playoff.

Another object is to provide a championship playoff system which encourages increased attendance during post-season games.

Still another object of the present invention is to provide a playoff system which more objectively determines a national champion than the current system.

The method for conducting a championship playoff includes the steps of ranking participating teams after a regular season by adding the ranks of each team based upon at least two different polls, and assigning a final rank for each team based upon the summation of these polls. A championship tournament is then conducted with a plurality of rounds of events to reduce the initial number of teams to a single champion. In the preferred embodiment of the invention, one poll is a poll of sports writers, a second poll is a poll of coaches, and a third poll is an objective poll, with the first and second polls being weighted more heavily than the objective poll. Each round of events in the championship playoff would be played at different site locations. A secondary tournament would be conducted utilizing the highest ranked teams below those which are utilized in the championship tournament. The secondary tournament would include a plurality of rounds of events to narrow the teams to a single champion of the secondary tournament. The secondary tournament rounds are played at different locations than the championship tournament rounds, and are played on different days than the championship rounds.

DESCRIPTION OF THE PREFERRED EMBODIMENT

The championship playoff system of the present invention is preferably scheduled to be played during the same period of time of current scheduling. In the preferred embodiment of the invention, the 13 weeks from the end of August through the week of Thanksgiving would be divided such that all teams would play an 11 game schedule during the first 12 weeks, and no games would be played the week of Thanksgiving. The first 12 weeks are therefore considered the "regular season", with each team having one week of the first 11 weeks as an "open" date with no game, and all teams playing their $11^{th}$ game the week before Thanksgiving.

At the end of the regular season, all of the participating teams are seated with a ranking, beginning with number one. In the preferred embodiment of the invention, there are in excess of 28 teams participating, but only the top 28 teams would be seated.

A poll configuration is utilized to seed the teams at the end of the regular season. Preferably, the two major polls currently being utilized—the coaches poll and the writers poll—would also be used as a major component of the poll configuration. However, the poll configuration would also include a third independent poll. The coaches poll and the writers poll would each be weighted twice as much as the third independent poll, with the weighted rankings being added to create an initial overall rank. As with poll rankings, the lower the total number, the higher the rank. In the event that two or more teams receive the same initial overall rank, the tie is broken by a secondary overall rank which is determined by adding the three poll rankings without weighting the rankings.

The following is an example of the poll configuration for five teams which are ranked differently in each of the three polls. As shown in this example, Florida has the lowest initial overall rank, and therefore has a final overall rank of number one. The secondary overall rank is used only in the event of a tie, and therefore is not utilized in Example 1.

EXAMPLE 1

| Coaches Poll | Writers Poll | Independent Poll |
|---|---|---|
| 1. Florida | 1. Nebraska | 1. Notre Dame |
| 2. Notre Dame | 2. Washington | 2. Miami |
| 3. Nebraska | 3. Florida | 3. Florida |
| 4. Washington | 4. Notre Dame | 4. Nebraska |
| 5. Miami | 5. Miami | 5. Washington |

| Final Rank | Weighted Poll Rankings | Initial Overall Rank | Unweighted Poll Rankings | Secondary Overall Rank |
|---|---|---|---|---|
| 1. Florida | 2 + 6 + 3 = | 11 | 1 + 3 + 3 = | 7 |
| 2. Nebraska | 6 + 2 + 4 = | 12 | 3 + 1 + 4 = | 8 |
| 3. Notre Dame | 4 + 8 + 1 = | 13 | 2 + 4 + 1 = | 7 |
| 4. Washington | 8 + 4 + 5 = | 17 | 4 + 2 + 5 = | 11 |
| 5. Miami | 10 + 10 + 2 = | 22 | 5 + 5 + 2 = | 12 |

In Example 2, it can be seen that Notre Dame and Florida have equal initial overall ranks. For this reason, the secondary overall rank is utilized to determine the seating of these two teams.

EXAMPLE 2

| Coaches Poll | Writers Poll | Independent Poll |
|---|---|---|
| 1. Florida | 1. Washington | 1. Notre Dame |
| 2. Nebraska | 2. Nebraska | 2. Nebraska |
| 3. Notre Dame | 3. Notre Dame | 3. Florida |
| 4. Washington | 4. Florida | 4. Washington |

| Final Rank | Weighted Poll Rankings | Initial Overall Rank | Unweighted Poll Rankings | Secondary Overall Rank |
|---|---|---|---|---|
| 1. Nebraska | 4 + 4 + 2 = | 10 | 2 + 2 + 2 = | 6 |
| 2. Notre Dame | 6 + 6 + 1 = | 13 | 3 + 3 + 1 = | 7 |
| 3. Florida | 2 + 8 + 3 = | 13 | 1 + 4 + 3 = | 8 |
| 4. Washington | 8 + 2 + 4 = | 14 | 4 + 1 + 4 = | 9 |

As noted above, the preferred embodiment of the playoff system calls for all of the teams to ranked, and then utilizes the top 28 teams to be divided into a championship tournament and a secondary tournament. While it should be clear that the number of teams for each tournament may vary, the preferred embodiment utilizes the top 12 teams in the championship tournament, and teams 13–28 in the secondary tournament. The final seedings and sites for the games should be made public on Thanksgiving Day to permit sufficient time for travel arrangements by fans.

The third independent poll may be an existing poll, or could involve a purely objective formula or similar point system. A gross point system formula typically will account for the strength of schedule as well as performance. Thus, the third independent poll could be less a poll and more a calculation to bring more objectivity to the final poll calculation. One example of a formula based calculation to rank teams for the third poll would be as follows:

FORMULA-BASED POLL #3

B = Base = Number of games of regular season played by a majority of Division I teams R = Principal team's winning percentage
where: a win = 1 unit
a tie = 0.5 unit $$R = \frac{[\text{number of wins} + (1.5)(\text{number of ties}]}{\text{total games played}}$$

OP = Principal team's opponents' winning percentage
OOP = Principal team's opponents' opponents' winning percentage
S = Number of games not played by principal team below base number of games
S = (base number of games) minus (total games played)
GP = Gross points accumulated, by which teams are ranked
(the highest points occupy the number 1 rank)

$$GP = RB + OP(.6)B + OOP(.5)B - RS$$
$$= B[R + (.6)OP + (.5)OOP] - RS$$

Starting from the day after Thanksgiving and continuing through and including New Year's Day, accounts for a minimum of 34 days to a maximum of 40 days. This variable period will be referred to as the "post-season" and is five weeks in length. Once the participating teams have been ranked, the preferred embodiment of the invention divides the top 28 teams into a championship tournament and a secondary tournament. While the number of teams playing in each tournament may vary, it is preferred that the top 12 teams play in the championship tournament and teams ranked 13–28 play in a secondary tournament.

The championship tournament would consist of four rounds, each round being played on a weekend beginning the weekend of the week following Thanksgiving, and the championship games (fourth around) being played on New Year's Day. Each round would be played at a different site, and could use the current major bowls for this purpose. Each site would host a different round and would rotate on an annual basis so that each of the four sites would host the championship game once every four years.

Utilizing 12 teams in the championship tournament, the top four seeds would have a "bye" in the first round. Four games would be played at the same site during the first round, with two games preferably played on a Friday and two games on a Saturday, with an appropriate intermission between games. In the second round, one week later, four games would be played at a second site, again with two games on Friday and two games on Saturday. In the third round, played one week after the second round at a new site, one game would be played on Friday and one game played on Saturday. With only two teams remaining, the teams would have an extra week off, including Christmas Day. The final championship game would then be played on New Year's Day at a fourth site.

The secondary tournament preferably includes 16 teams, played in four rounds. These games would be held at locations different from the four sites utilized in the championship tournament. Preferably, the sites for the first round games would be chosen by the top eight seeds in the secondary tournament to thereby create a more "home field" type environment for those teams which were higher ranked but failed to make the championship tournament. As with the championship tournament, subsequent games would also be played at different sites which could be secured by bids from the "minor" bowls.

Each round of games in the secondary tournament are preferably played on Thursdays, beginning the week after Thanksgiving, for the first three rounds. Round four, which would be the championship game in the secondary tournament, would be played on Christmas Day.

For each tournament, voluntary pay outs will be determined by the last round of participation, where schools not participating in the post-season would still receive a minimum percentage. In this way, all organizations would eventually benefit from the playoff format.

In the preferred embodiments of the invention, overtimes would be subject to different rules than currently exist. The overtime period would be treated as an extension of the game, with the same regulation rules applying in overtime as in the regular portion of the game. A coin toss determines which team will kick off and receive. In overtime, the first team to score is the winner, but a winning team must have either kicked off or punted to the opposing team at least one time. This provides an opportunity for a subsequent tie, if the first receiving team scores without punting, and then the opposing team scores an equal amount of points without punting after its first kickoff reception. In such an event, the next team to score wins the game. In the event that the teams score unequal amounts after each has received one kickoff (an onside kick is considered a kickoff), the team scoring the most points would be the winner. Two point conversions would remain a pertinent as a part of the overtime. There would be no time limit during the overtime period.

There are advantages to both teams during overtime. For example, assume that team A kicks off to team B and team B scores immediately. Team A must receive a kickoff and score at least as much on that possession. Team A could therefore utilize any fourth downs as an offensive play instead of a punt. Also, because team B scored first, team A would no the number of points needed to tie or surpass team B.

It can also be advantageous to receive first in overtime. Assume team B receives the first kickoff and scores immediately. Team A then scores an equal amount after receiving its first kickoff. At this point, the next team to score is the winner. Since the next possession belongs to team B, team B has the first opportunity to win the game.

Whereas the method of the present invention has been described in connection with the preferred embodiment thereof, many modifications, substitutions and additions may be made which are within the intended broad scope of the appended claims. For example, the number of teams utilized in the championship and second tournaments could be anything from three teams on up. The days on which the games are played and particular sequence of the games could easily be varied. Shorter or longer seasons for each team is possible. A third tertiary tournament could be added to the post-season for additional teams ranked below those in the championship and secondary tournaments. Or the tertiary tournament could be consolation games for those teams which lost in the first round of either or both the championship and secondary tournaments. Similarly, the polls could be of any type, whether subjective or objective, and could be of any number.

I claim:

1. A method for conducting a championship playoff among at least three participating teams, each team playing a plurality of games during a "regular" season, comprising the steps of:

ranking the participating teams after the regular season, comprising the steps of:

adding the rank of each participating team from a first poll to the rank of each team in a second poll to obtain an initial overall rank;

assigning a final rank for each team, with the lowest sum of the initial overall rank constituting the highest rank, and the highest sum from the initial overall rank constituting the lowest rank;

conducting a championship tournament with at least the three teams having the highest final rank, comprising the steps of:

conducting at least a first round of events to determine the two teams to play in a championship game; and conducting a championship game with the two teams determined from the previous round of events, to determine a champion.

2. The method of claim 1, wherein the first poll is a poll of sports writers, and wherein the second poll is a poll of coaches in the particular sport.

3. The method of claim 2, wherein the ranking step includes adding the sum of the ranks of the first and second polls for each team to the rank of each team in a third poll.

4. The method of claim 3, wherein the third poll is an objective poll, utilizing a formula to determine rank.

5. The method of claim 4, wherein the step of adding the sum of the ranks of the first and second polls to the third poll includes increasing the weight of the ranks of the first and second poll ranks relative to the third poll ranks.

6. The method of claim 5, wherein the weight of the first and second poll ranks are each twice the weight of the third poll rank.

7. The method of claim 6, further comprising the step of conducting a secondary tournament with at least three teams having the highest rank below the teams participating the in championship tournament, comprising the steps of:

conducting at least a first round of events to determine the two teams to play in a secondary championship event; and conducting a secondary championship event with the two teams determined from the previous secondary round, to determine a secondary champion.

8. The method of claim 7, wherein each round in the championship and secondary tournaments includes at least one game, and wherein each round of games is located at different site locations.

9. The method of claim 8, wherein the games of each round of the championship tournament are played on different days than the games of each round of the secondary tournament.

10. The method of claim 9, wherein the step of conducting the championship tournament includes the steps of:

selecting the 12 highest ranking teams from the participating teams;

conducting a first round of games at a first location wherein teams ranked 5–12 play to determine four first round winners;

conducting a second round of games at a second location, wherein the four first round winners and the teams ranked 1–4, play to determine four second round winners;

conducting a third round of games at a third location, wherein the four second round winners play to determine two third round winners; and conducting a championship game at a fourth location, wherein the two third round winners play each other.

11. The method of claim 10, wherein the step of conducting the championship tournament includes:

the step of conducting a first round of games over the weekend of the first full week after Thanksgiving;

the step of conducting the second round of games over the weekend of the second full week after Thanksgiving;

the step of conducting the third round of games over the weekend of the third full week after Thanksgiving; and the step of conducting the championship game on New Year's Day.

12. The method of claim 1, wherein the ranking step includes adding the sum of the ranks of the first and second polls for each team to the rank of each team in a third poll.

13. The method of claim 12, wherein the third poll is an objective poll, utilizing a formula to determine rank.

14. The method of claim 12, wherein the step of adding the sum of the ranks of the first and second polls to the third poll includes increasing the weight of the ranks of the first and second poll ranks relative to the third poll ranks.

15. The method of claim 1, further comprising the step of conducting a secondary tournament with at least three teams having the highest rank below the teams participating the in championship tournament, comprising the steps of:

conducting at least a first round of events to determine the two teams to play in a secondary championship event; and conducting a secondary championship event with the two teams determined from the previous secondary round, to determine a secondary champion.

16. The method of claim 15, wherein each round in the championship and secondary tournaments includes at least one game, and wherein each round of games is located at different site locations.

17. The method of claim 15, wherein the games of each round of the championship tournament are played on different days than the games of each round of the secondary tournament.

18. The method of claim 1, wherein the step of conducting the championship tournament includes the steps of:

selecting the 12 highest ranking teams from the participating teams;

conducting a first round of games at a first location wherein teams ranked 5–12 play to determine four first round winners;

conducting a second round of games at a second location, wherein the four first round winners and the teams ranked 1–4, play to determine four second round winners;

conducting a third round of games at a third location, wherein the four second round winners play to determine two third round winners; and conducting a championship game at a fourth location, wherein the two third round winners play each other.

19. The method of claim 1, wherein the step of conducting the championship tournament includes:

the step of conducting a first round of games over the weekend of the first full week after Thanksgiving;

the step of conducting the second round of games over the weekend of the second full week after Thanksgiving;

the step of conducting the third round of games over the weekend of the third full week after Thanksgiving; and the step of conducting the championship game on New Year's Day.

* * * * *